US005241092A

United States Patent [19]

Cheng et al.

[11] Patent Number: 5,241,092

[45] Date of Patent: Aug. 31, 1993

[54] DEODORIZING EDIBLE OIL AND/OR FAT WITH NON-CONDENSIBLE INERT GAS AND RECOVERING A HIGH QUALITY FATTY ACID DISTILLATE

[75] Inventors: Alan T. Y. Cheng, Livingston, N.J.; Jose R. Calvo; Ramon R. Barrado, both of Madrid, Spain

[73] Assignee: Praxair Technology, Inc., Danbury, Conn.

[21] Appl. No.: 698,803

[22] Filed: May 13, 1991

[51] Int. Cl.[5] ..... C11B 11/00

[52] U.S. Cl. ..... 554/205

[58] Field of Search ..... 260/428, 428.8; 554/205

[56] References Cited

U.S. PATENT DOCUMENTS

| | | | |
|---|---|---|---|
| 1,622,126 | 3/1927 | Wecker | 260/428 |
| 4,009,230 | 2/1977 | Smorenburg | 261/148 |
| 4,378,317 | 3/1983 | Seguine | 260/428 |

FOREIGN PATENT DOCUMENTS

| | | |
|---|---|---|
| 0041746 | 12/1981 | European Pat. Off. . |
| 195195 | 11/1982 | Japan . |
| 0902284 | 6/1989 | Spain . |

OTHER PUBLICATIONS

*Chemical Abstract*, vol. 109, No. 21, Ab. No. 189120X, Marschner et al, "Simultaneous Deodorization of and Cholesterol Removal From Fats and Oils by Steam Stripping", 1988.

*Chemical Abstract*, vol. 85, No. 22, Ab. No. 162303h, Lozheshnik, "Preparing Fat for Hydrogenating by Deodorizing in a Medium of a Circulating Inert Gas or Vapor under a Vacuum", 1976.

*Chemical Abstract*, vol. 103, No. 2, Ab. No. 11225y, "Counter-Current Stripping for Perfumes Using Nitrogen Gas", 1977.

*Primary Examiner*—José G. Dees
*Assistant Examiner*—Deborah D. Carr
*Attorney, Agent, or Firm*—Chung K. Pak

[57] ABSTRACT

The invention relates to a process for deodorizing edible oils and/or fats comprising: heating edible oil and/or fat to an elevated temperature; introducing or injecting non-condensible inert gas into said edible oil and/or fat to strip or remove substances that impart disagreeable odor and taste to said edible oil and/or fat; and recovering the resulting deodorized edible oil and/or fat, wherein an amount of said non-condensible inert gas introduced or injected is substantially less than the theoretically required amount for deodorizing said edible oil and/or fat. The condensible gas may be preheated before its introduction into the edible oil and/or fat.

20 Claims, 4 Drawing Sheets

DEODORIZING EDIBLE OIL AND/OR FAT WITH NON-CONDENSIBLE INERT GAS AND RECOVERING A HIGH QUALITY FATTY ACID DISTILLATE

BACKGROUND OF THE INVENTION

The invention relates generally to the use of a particular amount of non-condensible inert gas as a stripping medium in deodorizing edible oils and/or fats and more particularly to the use of substantially less than the theoretically required amount of nitrogen as a stripping medium in deodorizing edible oils and/or fats.

Deodorization is usually the final processing step in the production of edible oil and fat products. Commonly, edible oils or fats are subject to either chemical refining involving degumming, neutralizing, dewaxing, washing and filtrating steps or physical refining involving degumming, decoloring and filtering steps, prior to deodorization. The type of refining involved, i.e. chemical or physical refining, could dictate the operating conditions of deodorization. Severe deodorization operating conditions, for example, may be necessary to obtain edible oil and fat products having the desired characteristics when physical refining, as opposed to chemical refining, is employed prior to deodorization. The physical refining is likely to produce edible oils or fats having a greater amount of impurities than those produced by chemical refining due to the limited refining steps involved.

Deodorization basically involves stripping edible oils and/or fats to remove, among other things, substances that impart disagreeable odor and taste. The substances removed usually include free fatty acids; various disagreeable odor and taste causing compounds, such as aldehydes, ketones, alcohols and hydrocarbons; and various compounds formed by the heat decomposition of peroxides and pigments. These substances should be sufficiently removed to impart the desired property to the edible oil and/or fat. The fatty acids in the edible oils and/or fats, for example, should be substantially reduced, to about 0.1 to 0.2% to obtain the edible oil and/or fat having the desired properties.

During deodorization vapors are formed as a result of stripping the edible oils and/or fats with inert stripping gas at a high temperature condition. These vapors which contain valuable by-products, such as fatty acid and other impurities, can pose problems in the standpoint of waste disposal. The vapors are, therefore, usually condensed to produce condensates having valuable by-products. The condensation, like deodorization, is generally accomplished under high vacuum which may be generated by vacuum boosters and/or ejectors supplied with steam (motive steam). Motive steam employed to generate high vacuum, however, is contaminated by the vaporized impurities passing through the boosters and ejectors and needs to be treated before it can be disposed. The motive steam could, therefore, esculate the cost involved in operating deodorization systems unless its consumption can be reduced.

It has been known to employ steam (process steam) as a stripping gas in many deodorization systems. Process steam is suitable as a deodorizing stripping gas because of its high specific volume, inexpensiveness and easily condensable and removable characteristics. The amount of process steam theoretically necessary to maximize stripping may be determined by the following formula:

$$\text{Log}\,[(C^* - Ci)/(C^* - Cf)] = \frac{E\,Ac}{M}\,(Pv/P)\,S \qquad (1)$$

S = molar flow rate of the stripping steam
Pv = vapor pressure of the free fatty acid
P = total system pressure
C = molar concentration of fatty acid in the oil
M = total number of moles of edible oil and/or fat
E = vaporization efficiency
Ac = activity coefficient
C* = Fatty acid in the oil at equilibrium
Ci = initial molar concentration of free fatty acid
Cf = final molar concentration of fatty acid Commercially, the amount of process steam employed to maximize stripping is generally about 34 lb to about 39.6 lb of process steam per ton of edible oil or fat. In spite of the minimum amount of process steam involved, however, in removing the optimum amount of impurities in the edible oil and/or fat, motive steam consumption remains high. In addition, the use of process steam may lead to the reduction of deodorized edible oil and/or fat Products. Commercial deodorization systems employing about 34 lb to 39.6 lb of process steam per ton of edible oil and/or fat, for example, may lose up to about 0.5% by weight of edible oil and/or fat due to the entrainment and unwanted side reactions such as thermal decomposition and possibly hydrolysis reaction. The above problems are further compounded by the formation of a condensate containing a low percentage of fatty acid which results from cooling the vapor formed during steam deodorization. The condensate, due to its low fatty acid content, needs to be treated further in distillation equipment or needs to be disposed as a waste stream or as an animal feed after it is treated to remove all pollutants or contaminents.

As a result of the problems inherent in deodorization systems which employ process steam as a stripping gas, the use of nitrogen or other inert gas, in lieu of steam, as a stripping medium has been considered. Theoretically, equal molar of nitrogen or other inert gas is needed to replace equal molar of steam in deodorizing edible oils and/or fats. That is, equal moles of nitrogen or inert gas is theoretically needed to replace steam in order to carry the same amount of volatile or impurities as steam. The necessity for this theoretically required equal mole of nitrogen or other inert gas is expressed in terms of the thermodynamic relationship governing the removal of free fatty acid and other contaminents in the edible oils and/or fats:

$$Ya = \frac{Pa^*}{P_t + Pa^*} \qquad (1)$$

where

Ya = Equilibrium mole fraction of free fatty acid and other contaminants in the gas phase per mole of stripping gas.
Pa* = Equilibrium partial pressure of free fatty acid and other contaminants
$P_t$ = Total pressure As the equilibrium mole fraction of the free fatty acid in the gas phase increases, there is a higher tendency that the free fatty acid will be removed from the oil. The total moles of free fatty acid and other contaminants which can be removed at equilibrium conditions, are therefore defined by:

$$M_T = Ya\ M_{steam} \ldots \quad \ldots (2)$$

where $M_T$ = Total moles of free fatty acid and contaminating volatile removed.

$M_{steam}$ = Total moles of steam used The volume of nitrogen or other inert gas, however, may be calculated using ideal gas law since the deodorization system operates under vacuum.

$M_{steam} = TR/PV_{steam} \ldots (3)$ where

R = Gas constant

T = Absolute Temperature

P = Gas pressure $V_{steam}$ = Total volume of steam

It then logically follows that, by theory, equal volume or equal moles of nitrogen or other inert gas is required to replace equal volume or moles of steam in deodorizing edible oil and/or fat. Unfortunately, the use of the theoretical amount or equal moles of non-condensible nitrogen or other inert gases, in lieu of steam, as a stripping medium increases motive steam consumption as a result of passing an excessive amount of non-condensable inert gas to vacuum boosters and ejectors. Moreover, an increased amount of cooling water may be needed to condense the vapor formed during deodorization since the cooling system involved could be overloaded with an excessive amount of non-condensible inert gas. Indeed, "*Refining of Oils and Fats for Edible Purposes*", written by Andersen and published by Pergamon Press, The Macmillan Co., New York, teaches away from using a non-condensible gas, in lieu of steam, because of the difficulties involved in removing and recovering the non-condensible inert gas.

It is an advantage of the present invention in reducing any difficulties involved in using the non-condensible inert gas in deodorization systems.

It is another advantage of the present invention in reducing the required amount of motive steam and cooling water without compromising the quality of deodorized edible oils and/or fats.

It is yet another advantage of the present invention in increasing the fatty acid content in the recovered condensates.

It is a further advantage of the present invention in improving the stability of deodorized edible oils and/or fats.

It is an additional advantage of the present invention in increasing the yield of deodorized edible oils and or fats by reducing the entrainment of deodorized edible oil and/or fat by a stripping medium and by inhibiting side reactions which may be responsible for the formation of some impurities.

The above and other advantages will become apparent to one skilled in the art upon reading this disclosure.

SUMMARY OF THE INVENTION

According to the present invention, the above advantages are achieved by a process for deodorizing edible oils and/or fats comprising: heating edible oil and/or fat to an elevated temperature; introducing or injecting non-condensible inert gas into said edible oil and/or fat to strip or remove substances that impart disagreeable odor and taste to said edible oil and/or fat; and recovering the resulting deodorized oil and/or fat product, wherein an amount of said non-condensible inert gas introduced or injected is substantially less than the theoretically required amount for deodorizing said edible oil and/or fat. The edible oil and/or fat may be deodorized at a high vacuum in a deodorization tower having a plurality of vertically spaced trays or a plurality of cells. The non-condensible inert gas entering the tower may be apportioned among some of said plurality of cells or trays based their locations in the tower to facilitate the deodorization of said edible oil and/or fat. The amount of the non-condensible gas injected or introduced into at least one tray located in the upper portion of the tower or at least one first cell is greater than that injected or introduced into at least one tray located in the middle portion of the tower or at least one intermediate cell. The amount of the non-condensible gas injected or introduced into at least one lower portion of the tower or at least one final cell, however, is less than that injected or introduced into said at least one tray located in the middle portion of the tower or at least one intermediate cell. The non-condensible inert gas may be preheated prior to its introduction or injection into the trays or cells crosscurrently with respect to the direction of the movement or flow of said edible oil and/or fat.

As used herein, the term "edible oils and/or fats" means any oils and/or fats derived from vegetable and/or animal sources. The term "vegetable" may include, inter alia, olive, palm, coconut, soyabean, groundnut, cottonseed, sunflower, corn, etc. and the mixtures thereof while the term "animal" may include, inter alia, fishes, mammals, reptiles, etc. and the mixtures thereof.

As used herein, the term "non-condensible inert gas" means any inert gas which does not condense at the room temperature under the atmospheric condition. The non-condensible gas may include, inter alia, nitrogen, carbon dioxide, argon, helium, hydrogen and the mixtures thereof.

As used herein, the term "substantially less than the theoretical amount" means an amount of non-condensible gas, which is sufficiently less than the theoretically required amount so that the cost of using non-condensible stripping gas is equal to or cheaper than using steam stripping gas. The term "substantially less than the theoretical amount" generally includes about 230 scf of non-dondensible inert gas or less per ton of edible oil and/or fat.

As used herein "an elevated temperature" means a deodorization temperature.

DETAILED DESCRIPTION OF THE INVENTION

The invention relates to the discovery that the use of a particular amount of a non-condensible inert gas per ton of edible oil and/or fat reduces the amount of motive steam and cooling water employed in deodorization systems which could be operated in a continuous, semicontinuous or batchwise manner. The quality of deodorized edible oil and/or fat products is not compromised in attaining such a result. In fact, the edible oil and/or fat products formed are found to be more stable than those produced by steam stripping. When the non-condensible inert gas is introduced in a particular way and/or in a particular form, the removal of impurities in the edible oil and/or fat is also found to be improved. The removed impurities, once condensed, need not be discarded or further treated due to the presence of a large amount of fatty acid in the condensed impurities.

Figure 1:
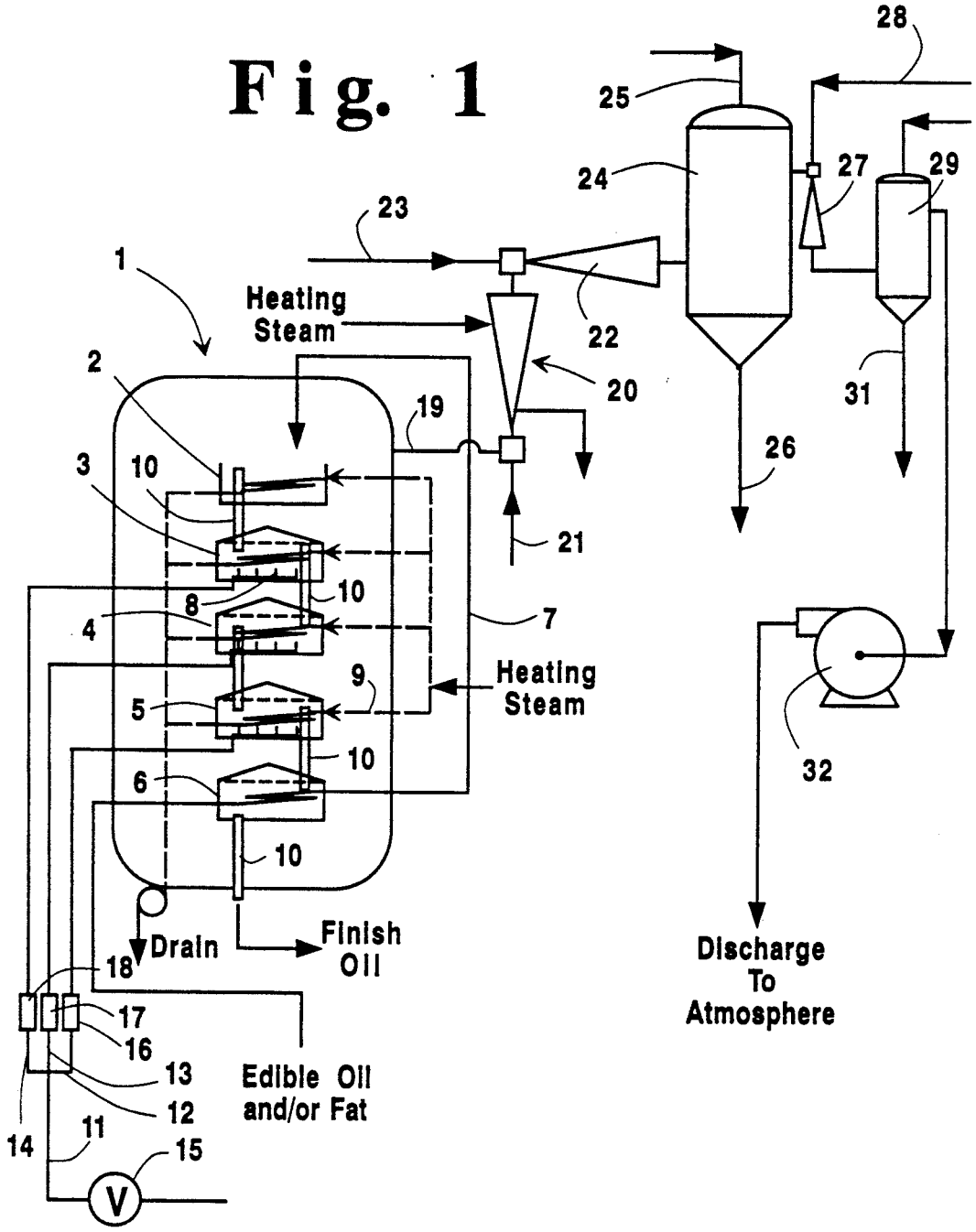
FIG. 1 is a schematic flow chart diagram of a deodorization system which illustrates one embodiment of the invention.

Now referring to FIG. 1, there is illustrated a schematic deodorization flow chart diagram which represents one embodiment of the present invention. In FIG. 1 a starting edible oil and/or fat material is delivered to the upper portion of a deodorization tower (1) having a plurality of trays (2,3,4,5 and 6) via a line (7). The starting edible oil and/or fat material may be preheated by indirectly heat exchanging with the discharging deodorized edible oil and/or fat product prior to its delivery to the upper portion of the deodorization tower (1). The indirect heat exchange can take place in one of the trays, particularly the bottom tray (6), in the deodorization tower or anywhere inside or outside the deodorization tower. At the bottom tray (6), however, the recovery of heat from the discharging deordorized oil and/or fat can be maximized and, at the same time, the deodorized edible oil and/or fat Product can be cooled before being discharged.

Usually, the starting oil and/or fat material fed to the deodorization tower is chemically or physically refined. Any starting oil and/or fat material including those which have been subject to at least one of degumming, neutralizing, filtrating, dewaxing, decoloring, bleaching, winterizing, hydrogenating, filtering and deaerating steps or those which have been refined and deodorized but degraded due to the passage of time and/or exposure to oxygen, nevertheless, may be utilized. The level of impurities in the starting oil and/or fat employed, however, may dictate the operating conditions of the deodorization tower. Severe operating conditions, for example, may be necessary as the impurities level in the starting material fed to the deodorization tower increases.

Once the starting oil and/or fat material is fed to the upper portion of the deodorization tower, it flows downwardly over a plurality of vertically spaced trays (2,3,4,5 and 6) in the deodorization tower (1). All or some of the trays may be equiped with stripping gas introduction means(8) and indirect heating means (9). While the stripping gas introduction means (8), such as sparging or distributing means having particular orifice sizes, are preferably placed in at least one upper, middle and lower trays (3,4 and 5), respectively, the indirect heat exchange means(9) may be placed in all the trays (2,3,4 and 5) except for the bottom tray (6). Both the quantity and the type of indirect heat exchange means and stripping gas introducing means employed, however, may not be critical as long as the starting material in the deodorization tower is subject to a particular amount of a stripping gas at a deodorization temperature of at least about 130° C.

As the starting edible oil and/or fat material travels from one tray to another via downcomers (10), a non-condensible stripping inert gas is introduced to the tower through conduits (11, 12, 13 and 14) and enters the stripping gas introducing means (8) located at the bottom portions of at least one upper tray (3) at least one middle tray (4) and at least one lower tray (5). From the stripping gas introducing means, the non-condensible inert gas flows upwardly countercurrent to and in contact with the oil and/or fat flowing downwardly under a pressure of about 0.1 to about 6 mmHg vacuum and a temperature of about 150° C. to about 270° C. The amount on the non-condensible inert gas entering the tower may be controlled by a valve (15) to provide about 22 scf of non-condensible inert gas per ton of edible oil and/or fat to about 230 scf of non-condensible inert gas per ton of edible oil and/or fat, preferably about 70 scf of non-condensible inert gas per ton of edible oil and or fat to about 170 scf of non-condensible inert gas per ton of edible oil and/or fat. The amount of the non-condensible gas entering the tower should be at least the minimum necessary to produce a deodorized edible oil and/or fat product having the desired characteristics. The minimum amount of the non-condensible gas may vary depending on the types of edible oil and/or fats involved as shown in Table A.

TABLE A

Minimum Nitrogen Requirement Determined in Several Types of Edible Oil

| TYPE OF OIL | MINIMUM NITROGEN FLOW RATE |
|---|---|
| Olive oil | 96 scf/ton |
| 20% soybean, 80% sunflower | 105 scf/ton |
| Animal tallow | 168 scf/ton |

The minimum amount of the non-condensible gas can also vary depending on the deodorization conditions involved.

The use of the minimum amount of the non-condensible inert gas is preferred as it represents savings in motive steam consumption and cooling water consumption in deodorization systems.

The minimum amount of the non-condensible inert gas entering the tower may be distributed among at least one upper tray, at least one middle tray and at least one lower tray located in the upper, middle and lower portions of the tower. The amount of the non-condensible inert gas entering at least one upper tray, at least one middle tray and at least one lower tray may be regulated by valves (not shown) or controlled by altering or adjusting the opening sizes of orifices (16, 17 and 18). Preferably, the valves and/or the orifice opening sizes (16, 17 and 18) are adjusted to provide about 33% to about 65% by volume of the non-condensible gas entering the tower to at least one upper tray (3), about 25% to about 50% by volume of the non-condensible gas entering the tower to at least one middle tray (4), and about 10% to about 33% by volume of the non-condensible gas entering the tower to at least one lower tray (5). Other suitable gas distributing means, i.e., feeding the non-condensible gas separately under different pressures, is also viable in distributing or introducing the specified amount of the non-condensible inert gas to the upper, middle and lower trays.

To enhance the stripping action of the non-condensible inert gas, the non-condensible inert gas may be preheated prior to its introduction into the edible oil and/or fat. The primary purpose of increasing the temperature of the non-condensible inert gas is to decrease the sizes of gas bubbles which are formed as a result of introducing or injecting the non-condensible gas into the oil and/or fat. By reducing the sizes of the gas bubbles, the mass transfer of fatty acid and odoriferous substances to the gas phase is improved due to the increased gas-liquid interfacial area for a given volume of a stripping gas employed. This increased mass transfer rate can be further ameliorated by reducing the opening sizes of orifices for injecting the non-condensible gas and by injecting the non-condensible gas at a sonic velocity. The use of the small orifice openings and sonic velocity may promote the further reduction of gas bubble sizes.

During deodorization, the vapors containing, inter alia, a non-condensible stripping gas, fatty acid and other odoriferous substances are formed. The vapors are withdrawn from the deodorization tower (1) through a conduit (19) which is in communication with a vacuum booster (20) or thermal compressor (not shown). Steam, herein referred to as motive steam, may be supplied to the vacuum booster (20) through a conduit (21) and the vacuum booster (20) delivers the vapors and motive steam into the entrance of another vacuum booster (22), into which motive steam may be delivered by a conduit (23). The vacuum boosters (20 and 22) are well known in the art and usually include a venturi passageway with a steam jet directing motive steam axially in the direction of vapor flow into the restricted portion of the venturi passage. These boosters may be used to provide a high vacuum in the deodorization tower. While a single pair of vacuum boosters (20 and 22) are employed, it will be understood that as many pairs as are necessary may be provided to operate in parallel with the pair (20 and 22) in order to handle or accommodate the large volume of vapors from the deodorization tower. Enlarging the sizes of the boosters (20 and 22) to accomodate the large volume of vapors may also be viable.

The vapors and steam from the vacuum booster (22) may be introduced into a condenser (24) where they are brought into direct contact with a jet of cooling water supplied through a pipe (25). The condenser (24) is preferably a head barometric condenser which is operated at a pressure of about 5 mmHg to about 300 mmHg with a cooling water having a temperature of about 20° C. to about 50° C. The condensate resulting from cooling the vapors in the condenser (24) is recovered from an outlet (26). Any vapors which are not condensed may be withdrawn from the condenser (24) by means of a steam-jet ejector (27) which is supplied with motive steam through conduit (28). The steam-jet ejector is well known in the art and usually include a venturi passageway with a steam jet directing motive steam axially in the direction of vapor flow into the restricted portion of the venturi passage. It may be used to provide a high vacuum pressure condition in the condenser (24). While one steam ejector is illustrated, it will be understood that as many ejectors as are necessary may be provided to handle the large volume of vapors from the deodorization tower. Enlarging the sizes of the ejector to accomodate the large volume of vapors may also be viable.

The uncondensed vapors and steam from the steam-jet ejector may be introduced into a condenser (29) where they are again brought into direct contact with a jet of cooling water supplied through a pipe (20). T he condenser (29) is preferably a secondary barometric condenser which is operated at a pressure of about 50 mmHg to about 500 mmHg vacuum with a cooling water having a temperature of about 2° C. to about 50° C. The resulting condensate from the condenser (29) is recovered from an outlet (31) while the uncondensed vapors comprising non-condensible gas are removed to the atmosphere via a vacuum Pump (32) steam ejector (not shown) or other mechanical removing means (not shown).

Figure 2:
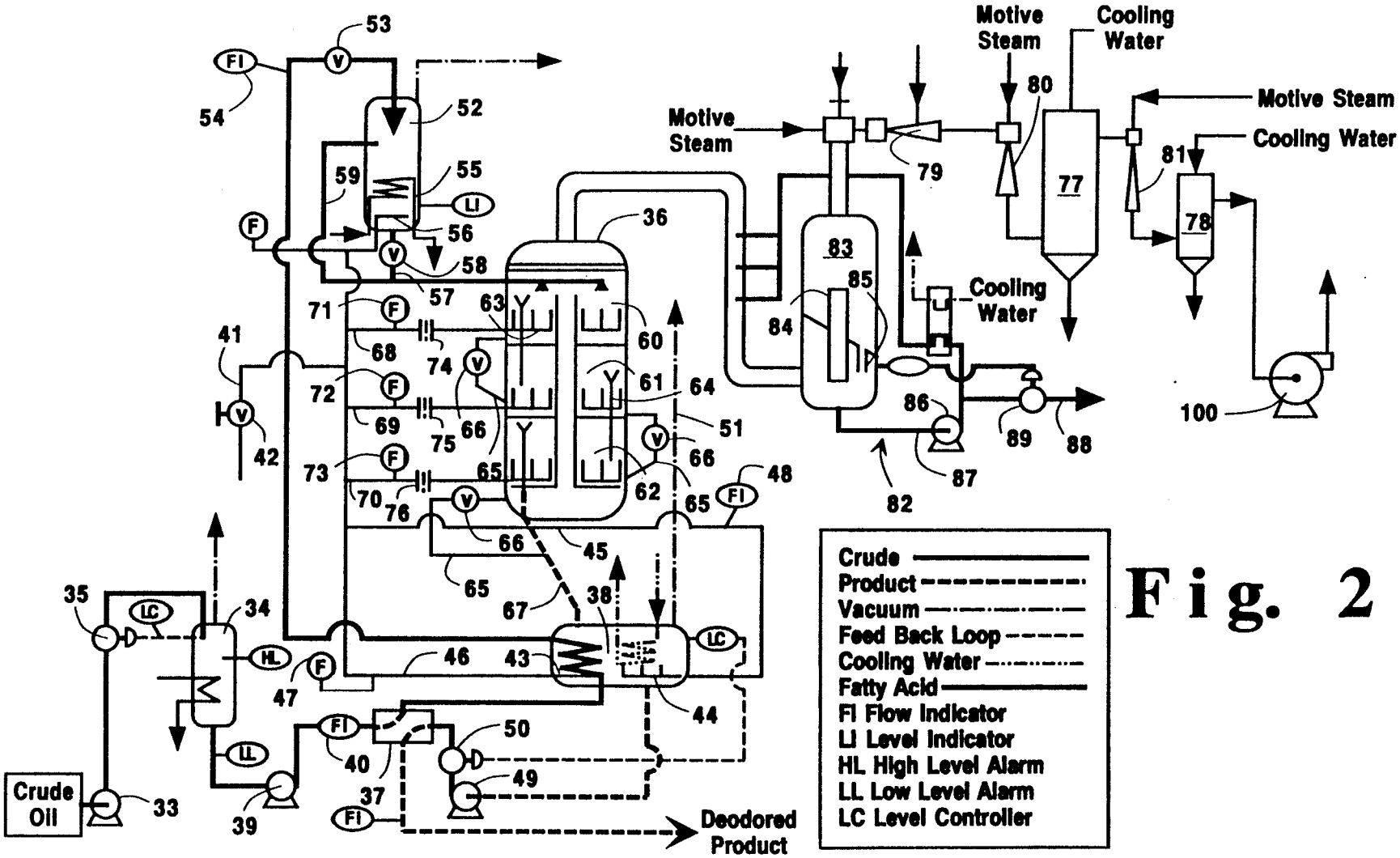
FIG. 2 is another schematic flow chart diagram of a deodorization system which illustrates one embodiment of the invention.

In reference to FIG. 2, there is illustrated another schematic deodorization flow chart diagram which represents one embodiment of the present invention. In this Figure, the starting edible oil/fat material above is delivered via a pump (33) to a thermal heater (34) which is operated at a temperature of about 25° C. to about 100° C. The amount of the starting material delivered to the thermal heater (34) is controlled by a valve (35) which is generally adjusted based on the level of the starting material in the thermal heater (34). The thermal heater may be equiped with high level and low level alarms to provide output signals to the valve (35), thus regulating the flow of the starting material entering the heater by adjusting the valve (34) in accordance with the output signals.

The preheated starting material may be further heated when it is used to cool the deodorized edible oil and/or fat product discharging from a deodorization tower (36). The preheated starting material for example, is delivered to indirect heat exchangers (37) and (38) via a pump (39). The rate at which the starting material is delivered may be monitored via a flow indicator (40) and may be regulated by the pump (39) to obtain both the starting material and the deodorized product which have the desired temperature conditions. To enhance the heat transfer from the deodorized product to the starting material and to cool the deodorized product uniformly to about 100° C. or less, the deodorized product may be fed countercurrently with respect to the direction of the flow of the starting material in the heat exchanger (37 and 38) and may be agitated with a non-condensible inert gas in the presence of additional cooling means in the heat exchanger (38). The non-condensible inert gas is provided from a conduit (41) having a valve (42) to gas introducing means (43 and 44) through conduits (45 and 46) having flow indicators (47 and 48) respectively. The amount of the deodorized product removed from the heat exchanger (38) is controlled by a pump (49) and/or a valve (50) which is regulated by the level of the deodorizd product in the heat exchanger (38). The non-condensible inert gas in the heat exchanger (38) may be withdrawn through a conduit (51) and may be sent to condensers directly or through vacuum boosters.

The starting material from the heat exchanger (38) is fed into a deaerator (52) to remove air therein. The amount of the starting material fed into the deaerator (52) could be regulated by a valve (53). The use of a flow indicator (54) is helpful in adjusting the flow rate of the starting material, which may impart the desired amount of the starting material in the deaerator (52). The adjustment is generally made based on the desired amount of the starting material to be treated in the deodorization tower (36). The deaerator (52) may be heated at about 100° C. to about 270° C. with a heating element (55) containing a thermal fluid and may be provided with a non-condensible inert gas such as nitrogen, using gas distributing means (56) that communicates with the conduit (41) to maximize the removal of the air entrained in the starting material. The non-condensible inert gas and removed air in the deaerator are continuously withdrawn and sent to condensers (77 and 78) while the deaerated starting material is continuously fed to the deodorization tower (36) through a conduit (57) having a valve (58) and/or a conduit (59).

The deodorization tower comprises at least one first cell (60), at least one intermediate cell (61) and at least one final cell (62), each having at least one compartment containing at least one gas distributing means (63). The cell may be arranged vertically one over the other, as shown in FIG. 2, or may be arranged horizontally one next to the other. At least one means for conveying a portion of the deodorizing oil and/or fat from one one cell to another may be provided within the tower or outside the tower. At least one overflow pipe (64), for example, may be used inside the tower to convey a portion of the deodorizing oil and/or fat in some of the cells or compartments thereof to their proceeding cells or compartments thereof while at least one conduit system (65) having a valve (66), for example, may be employed outside the tower to transfer a portion of the deodorizing or deodorized oil from one cell to another or to the discharging pipe (67).

The tower is operated at a temperature of about 150° C. to to about 270° C. and a pressure of about 0.1 mmHg to about 6 mmHg to promote deodorization of the deaerated starting material which flows from at least one first cell to at least one final cell in the tower. A non-condensible inert stripping gas is introduced into the material through the gas distributing means (63) in each cell, which communicates with the conduit (41) via conduits (68), (69) (70). The amount of the non-condensible gas entering the conduits (68), (69) and 70 may be monitored using flow indicators (71), (72) and (73) respectively and may be regulated by adjusting the opening sizes of orifices (74), (75) and (76) respectively to provide particular mounts of the non-condensible gas to at least one first cell, at least one intermediate cell and at least one final cell. Valves (not shown) may be implemented in lieu of or in addition to the orifices to provide a particular amount of the non-condensible inert gas to each cell. The particular amount of the non-condensible gas fed to each cell corresponds to that fed to each tray in the deodorization tower in FIG. 1. The largest portion of the non-condensible gas fed to the tower is delivered to at least one first cell which is in the vicinity of where the deaerated starting material is fed and the smallest portion of the non-condensible gas fed to the tower is delivered to at least one final cell which is in the vicinity of the deodorized product outlet.

During deodorization, the vapors containing, inter alia, the non-condensible gas, fatty acid and other odoriferous substances are formed. The vapors are withdrawn and may be directly delivered to condensers (77) and (78) using vacuum boosters (79 and 80) and steam-jet ejector (81) to recover condensates having fatty acid as previously indicated in the context of FIG. 1. Optionally, a scrubber system (82) may be employed to treat the vapors prior to delivering them to the first condenser (77) via the boosters (79 and 80) to recover fatty acids, thereby minimizing the contamination of motive steam employed in the boosters and ejector. The scrubber system (82) comprises a scrapper means (83) having a vapor upflow pipe (84) and a liquid downflow pipe (85), a pump means (86) for removing fatty acid condensate from the scrubber through a conduit (87), a cooling means for further cooling the condensate passing through conduit (87) to recycle the cooled condensate to the scrapper (83). The fatty acid containing condensate is usually recovered through a line (88). The amount of the condensate recovered in the line (88) is regulated by using a pump means (86) and a valve means (89). The valve means is usually adjusted based on the level of the condensate in the scrapper. Any uncondensed vapors are withdrawn from the scrubber (83) and then delivered to the condensers (77 and 78) via boosters (79 and 80) and ejector (81) to recover additional condensates as indicated above. Any uncondensed vapors comprising non-condensible gas from the condenser (78) are removed to the atmosphere via a vacuum pump (100).

The following examples serve to illustrate the invention. They are presented for illustrative purposes and are not intended to be limiting.

EXAMPLE 1

Olive oil containing about 0.24 lb of air/ton of olive oil was processed in the arrangement illustrated in FIG. 1. Olive oil was fed at about 165 tons/day into a deodorization tower having a plurality of trays after it was preheated by indirectly heat exchanging with the discharging deodorized olive oil. Process steam was introduced into the tower as a stripping gas to remove free fatty acids, volatile odoriferous and flavorous substances which were responsible for the smell and taste of undeodorized olive oil. About 34 lb of process steam was employed for each ton of untreated olive oil. The tower was operated at a pressure of about 1.5 Torrs and a temperature of about 260° C. to promote deodorization of olive oil. Once the olive oil was stripped of fatty acids and volatile odoriferous and flavorous substances, it was cooled by indirectly heat exchanging with the incoming undeodorized olive oil and then was recovered from the discharge pipe. The resulting vapor from the deodorization tower, which contained, among other things, fatty acids and other volatile substances, was fed to a head barometric condenser via the first and second vacuum boosters. Motive steam was supplied under a pressure of about 8 kg/cm$^2$ to the vacuum boosters to pressurize the deodorization tower and to feed the vapor into the head barometric condenser which was operated at a pressure of about 50 Torrs. The vapor fed to the head barometric condenser was cooled to produce a condensate when it was directly contacted with a jet of water having a cooling temperature of about 30° C. The condensate was then recovered while the uncondensed vapor was sent to a secondary barometric condenser via a steam ejector. Motive steam was supplied to the steam ejector under a pressure of about 8 kg/cm$^2$ to maintain the pressure of the head barometric condenser at about 50 Torrs and to feed the uncondensed vapor into the secondary barometric condenser. In the secondary barometric condenser, the uncondensed vapor was cooled at a pressure of about 120 Torrs with a cooling water having a temperature of about 30° C. to produce an additional condensate. Any uncondensed vapor in the secondary barometric condenser, which contained dissolved air, was removed via a vacuum pump to the atmosphere. The above experiment was repeated under the same operating conditions except that nitrogen was used in lieu of process steam as a stripping gas. The amount of nitrogen employed was about 1.9 lb moles of nitrogen/ton of olive oil (about 741 scf of nitrogen/ton of olive oil), which was theoretically required to replace 34 lb of process steam/ton of olive oil (1.9 lb moles of process steam/ton of olive oil). The use of the theoretical amount of nitrogen in the deodorization system was unsuccessful because of the mobility to provide high vacuum in the deodorization tower. The experiment was again repeated using only about 96 scf of nitrogen/ton of olive oil (about 0.25 lb moles of nitrogen/ton of olive oil), which was substantially less than the theoretically required amount of nitrogen. The operating conditions were exactly the same as above except that the deodorization tower was operated at a pressure of about 2 mmHg vacuum. The amounts of motive steam and cooling water required for the experiments stated above are shown in Table I below.

TABLE 1

| PROCESSING STEP | CONVENTIONAL PROCESS WITH PROCESS STEAM | THEORETICAL NITROGEN | ACTUAL NITROGEN USED IN THIS INVENTION |
|---|---|---|---|
| Deodorizer stripping gas | 34 lb/ton (Steam) | 741 scf/ton (Nitrogen) | 96 scf/ton (Nitrogen) |
| Vacuum Ejector Steam Requirement | | | |
| 1st Stage Booster | 96 lb/ton | 77 lb/ton | 19 lb/ton |
| 2nd Stage Booster | 218 lb/ton | 239 lb/ton | 45 lb/ton |
| 3rd Stage Ejector | 15 lb/ton | 271 lb/ton | 52 lb/ton |
| Total steam | 301 lb/ton | 587 lb/ton | 116 lb/ton |
| Cooling Water | 4,650 gal/ton | 8,298 gal/ton | 1,050 gal/ton |

Figure 3:
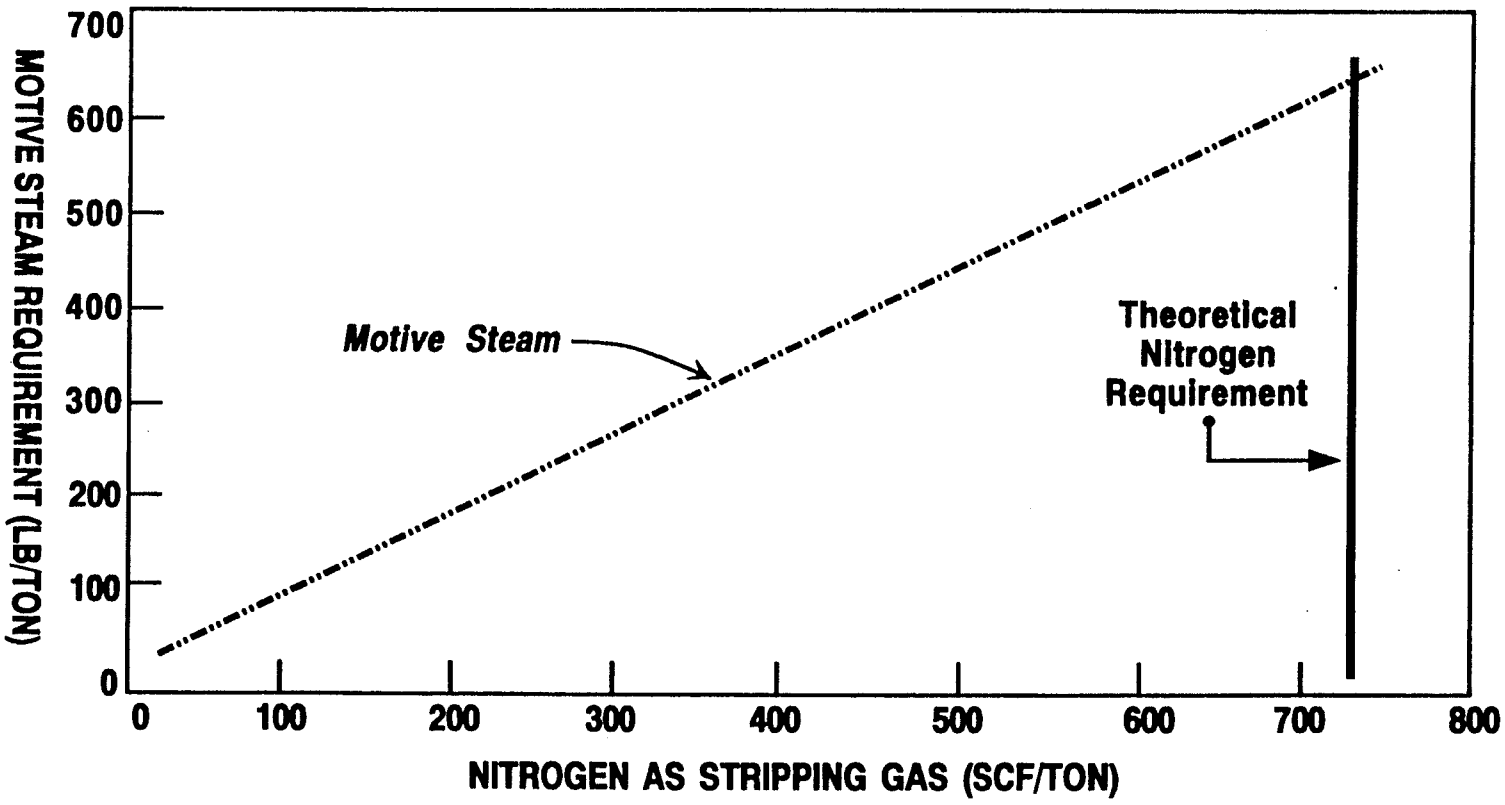
FIG. 3 is a graph illustrating the total motive steam requirement at various nitrogen flow rates.
Figure 4:
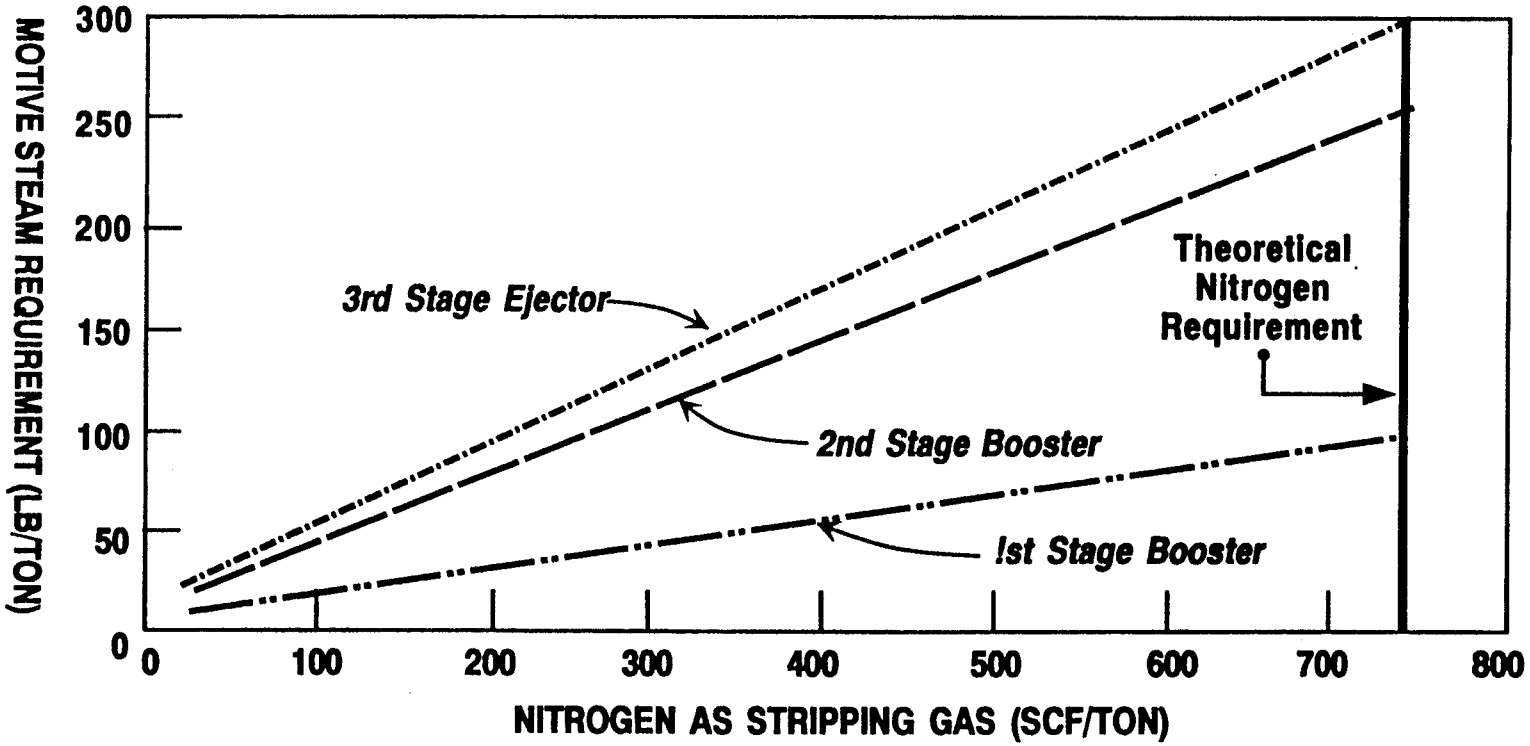
FIG. 4 is a graph illustrating the individual motive steam requirement for vacuum boosters and ejector at various nitrogen flow rates.

As shown in Table I, the total motive steam and cooling water necessary to engender high vacuum conditions in the deodorization system and to recover condensates from the vapor resulting from deodorization were substantially reduced when substantially less than the theoretically required amount of nitrogen was used, in lieu of steam, as a stripping gas. This reduction in the motive steam and cooling water requirement indicates the importance of using substantially less than the theoretically required amount of nitrogen in deodorization processes. Using the data in Example 1, the individual vacuum stage motive steam requirements and the total motive steam requirements for given nitrogen flow rates were determined. FIGS. 3 and 4 reflect the extrapolation of the data in Example 1. As shown in FIGS. 3 and 4, the motive steam requirement increases with the increased flow rate of nitrogen.

EXAMPLE 2

As in the previous examples, the arrangement illustrated in FIG. 1 was used to deodorize olive oil. The deodorization tower was operated at a temperature of about 260° C. and a pressure of about 2 mmHg vacuum. The temperature of the nitrogen gas fed into the tower was at about 30° C. maximum. The remaining operating conditions were identical to the previous Example 1. Using the flow rates and utility consumption as shown in Table I, the following results as shown in Table II were obtained.

TABLE II

| Inert gas | Process Steam | Nitrogen |
|---|---|---|
| Gas flow rate, lbmole/ton | 1.9 (34 lb/ton) | 0.25 (96 scf/ton) |
| Crude oil acidity, % | 4.0 | 4.0 |
| Organo-leptic properties | Good | Good |
| Color | Good | Good |
| Product acidity, % | 0.08–0.15 | 0.05–0.15 |

As shown in Table II, the characteristics of the deodorized olive oils, which were produced from steam stripping and nitrogen stripping, were substantially identical. The use of substantially less than the theoretically required amount of nitrogen was shown to reduce a substantial amount of utility consumption without adversely affecting the quality of deodorized olive oil.

EXAMPLE 3

Olive oils having different acidities were deodorized under various deodorizing temperatures in the arrangement illustrated in FIG. 1. Nitrogen having a temperature of about 40° C. was injected into the deodorization tower as a stripping gas at a rate of about 0.29 lb mole of nitrogen gas/ton of olive oil (112 scf of nitrogen/ton of oil), which was substantially less than the theoretically required amount of nitrogen (1.9 lb mole of nitrogen/ton of olive oil). The deodorization tower was operated at a pressure of about 1.5 mmHg vacuum. The remaining operation conditions were the same as in Example 1. The deodorized olive oil products having particular characteristics were obtained as shown in Table III below:

TABLE III

| | #1 | #2 | #3 | #4 | #5 | #6 |
|---|---|---|---|---|---|---|
| Deodorization Temperature, °C. | 256 | 260 | 261 | 262 | 263 | 258 |
| Crude Oil Acidity, % | 4.10 | 4.10 | 3.5 | 3.5 | 3.5 | 3.6 |
| Condensed Fatty Acid, Acidity, % | 73.0 | 76.0 | 78.0 | 75.4 | 74.9 | 75.6 |
| Refined Oil Acidity, % | 0.12 | 0.08 | 0.10 | 0.10 | 0.10 | 0.10 |

As shown in Table III, the use of substantially less than the theoretically required amount of nitrogen produced, condensates having a high percentage of fatty acid without adversely affecting the quality of the olive oil product. In contrast, the use of process steam as a stripping gas in the arrangement illustrated in FIG. 1 generally produced condensates having about 30 to 65% fatty acid.

EXAMPLE 4

A physically refined olive oil was deodorized in the arrangement illustrated in FIG. 1. Nitrogen, which was preheated to about 130° C., was introduced into the deodorization tower at a rate of about 0.33 lb mole of nitrogen/ton of olive oil (about 128 scf of nitrogen/ton of olive oil). This nitrogen flow rate was substantially less than the theoretically required amount of nitrogen (about 1.9 lb mole of nitrogen/ton of olive oil). The deodorization tower was operated at a pressure of about 2 mmHg vacuum and at a temperature of about 240° to 260° C. The remaining operating conditions were the same as in Example 1. The above experiment was then repeated using steam as a stripping medium. The resulting deodorized olive oil products are shown in Table IV.

TABLE IV

| | Process Steam | Nitrogen |
|---|---|---|
| Stripping Gas Flow Rate | 1.9 lbmole/ton (34 lb/ton) | 0.33 lbmole/ton (128 scf/ton) |
| Deodorization Temperature | 250° C. | 250° C. |
| Crude Oil Acidity, % | 1.5 | 1.5 |
| Refined oil acidity, % | 0.08–0.15 | 0.08–0.15 |
| E-270 | Good | Better |

EXAMPLE 5

A chemically refined mixture of soybean and sunflower oils were deodorized in the arrangement illustrated in FIG. 1. The deodorization tower was operated at a pressure of about 2 mmHg. The remaining operating conditions were the same as in Example 1. The particular stripping gases employed and the products obtained are shown in Table V.

TABLE V

| Stripping gases | Process Steam | Nitrogen |
|---|---|---|
| Gas flow rate, lbmole/tone of oil | 1.9 lb mole steam | 0.29 lb mole of nitrogen/ ton of oil |
| Input Oil Acidity, % | 0.06 | 0.06 |
| Output Oil Acidity, % | 0.03 | 0.03 |
| Peroxide Index, mg/l | 0–0.05 | 0–0.01 |
| Flavor | O.K. | O.K. |

As shown in Tables IV and V, the use of substantially less than the theoretically required amount of nitrogen enhances the quality of edible oils and/or fats.

EXAMPLE 6

Sunflower oil was deodorized in the deodorization tower illustrated in FIG. 2 using Particular deodorization conditions as shown in Table V(A).

TABLE V(A)

| Stripping Gas | Nitrogen | Steam |
|---|---|---|
| Flow Rate | 198 scf nitrogen/ ton of oil | 301 lb steam/ ton of oil |
| Input Oil acidity, % | 0.08 | 0.08 |
| Deodorization temp. | 230° C. | 230° C. |
| Deodorization pressure | 2 mmHg | 2 mmHg |
| Output Oil acidity, % | 0.065 | 0.065 |
| Output Oil (Product) yield | 319 ton/day | 275 ton/day |

As shown in Table V(A), the quantity of the deodorized edible oil and/or fat is increased dramatically when substantially less than the theoretically required amount of nitrogen is used in lieu of steam.

EXAMPLE 7

Physically refined animal tallow was deodorized in the arrangement illustrated in FIG. 1 The type of stripping gases, oil flow rates, stripping gas flow rates, deodorization temperatures and nitrogen temperatures used are shown in Table VI. The remaining operating conditions were the same as in Example 5. Under these conditions, the products as shown in Table VI were recovered.

TABLE VI

| Stripping Gas | Nitrogen | Nitrogen | Nitrogen | Nitrogen |
|---|---|---|---|---|
| Edible oil flow rate (ton/hr) | 4.24 | 4.24 | 3.86 | 3.86 |
| Stripping gas flow rate (lbmole/ton) | 0.41 | 0.43 | 0.52 | 0.54 |
| Deodorization temperature, °C. | 250 | 250 | 250 | 250 |
| Nitrogen temperature, °C. | 250 | 250 | 250 | 250 |
| Organoleptic characteristics | Good odor, bad taste | Good odor, good taste | Good odor, good taste | Good odor, good taste |
| Output acidity | 0.08 | 0.063 | 0.06 | 0.048 |
| N2 temperature | 250 | 260 | 250 | 250 |

As shown in Table VI, the improvement in the properties of the treated tallow, such as organoleptic and acidity characteristics, was shown to be dependent on the flow rate of nitrogen. The stability of the tallow was also shown to increased from about two hours 50 minutes to about seven hours 15 minutes when nitrogen, instead of steam, was used as a stripping gas. The taste of the tallow was also enhanced by employing nitrogen as a stripping gas.

EXAMPLE 8

A mixture containing 80% by weight sunflower oil and 20% by weight soybean oil was deodorized in the arrangement illustrated in FIG. 2. The deodorization conditions were identical to those used in Example 5 except for the stripping gas flow rates provided in table VI(A).

TABLE VI(A)

| Stripping gas | Nitrogen | Nitrogen |
|---|---|---|
| Flow rate | 105.9 scf nitrogen/ton oil | 128.4 scf nitrogen/ton oil |
| Racimad Stability Test | 4.5 hours | 7.5 hours |

As shown in Table VI(A), the stability of oil is increased with the increased amount of nitrogen.

EXAMPLE 9

A chemically refined mixture containing 20 (wt. or vol) % soybean oil and 80 (wt or vol) % sunflower oil was deodorized in the deodorization tower illustrated in FIG. 1. The deodorization conditions employed were identical to Example 1 except that a stripping gas was delivered to four different trays in the tower. Four different size orifices were installed in the tower, one for each tray, to distribute a different amount of the stripping gas in each tray. The sizes of orifices were altered to provide a greater amount of the stripping gas in the upper tray. The particular stripping gas flow rates and orifice sizes used are provided in Table VII. The characteristics of the resulting products are also provided in Table VII.

TABLE VII

| Inert Gas | Steam | Nitrogen | Nitrogen |
|---|---|---|---|
| Gas flow rate | 34 lb/ton | 105 scf/ton | 105 scf/ton |
| Top orifice size | 2.5 mm | 2.5 mm | 0.94 mm |
| Second orifice size | 2.0 mm | 2.0 mm | 0.75 mm |
| Third orifice size | 2.0 mm | 2.0 mm | 0.75 mm |
| Bottom orifice size | 1.5 mm | 1.5 mm | 0.56 mm |
| Peroxide Index, mg/l | 0–0.05 | 0.2–0.4 | 0–0.01 |

TABLE VII-continued

| Inert Gas | Steam | Nitrogen | Nitrogen |
|---|---|---|---|
| Input oil acidity | 0.06 | 0.06 | 0.06 |
| Product acidity, % | 0.03 | 0.04–0.06 | 0.03 |
| Flavor | O.K. | Bad | O.K. |
| Stability | O.K. | Bad | O.K. |

As shown in Table VII, the quality of the resulting oil product is enhanced when nitrogen is distributed in a particular manner. Distributing nitrogen in the same manner as steam may result in an unstable oil product having a bad flavor.

EXAMPLE 10

An animal tallow having an acid value of 4% was deodorized in the arrangement illustrated in FIG. 1 in the presence of nitrogen stripping gas which was preheated to various temperatures as shown in Table VIII. The animal tallow was fed at 4.235 tons/hour into the deodorization tower which was operated at a pressure of about 1 to 2 mmHg vacuum and at a temperature of about 250° C. The test results are shown in Table VIII below:

TABLE VIII

| Preheated Nitrogen temperature | 240° C. | 250° C. | 260° C. |
|---|---|---|---|
| Nitrogen flow rate | 144 scf/ton | 144 scf/ton | 160 scf/ton |
| Output acidity, % | 0.218% | 0.08% | 0.058% |
| Organoleptic characteristics | Good odor, bad taste | Good odor, bad taste | Good odor, good taste |

As shown in Table VIII, the quality of edible oil products can be improved when nitrogen is preheated to a high temperature prior to using it in deodorization as a stripping medium.

EXAMPLE 11

Nitrogen gas was fed to the deodorization tower illustrated in FIG. 1 at various temperatures as shown in Table IX.

TABLE IX

| # | 1 | 2 |
|---|---|---|
| Deodorization temperature | 500° F. | 500° F. |
| Flow rate of nitrogen/ ton of edible oil | 96 scf/ton of edible oil | 96 scf/ton of edible oil |
| Nitrogen temperature | Room temperature | 650° F. |
| Gas bubble sizes, diameter | 6.07 mm | 4.76 mm |
| The surface area to volume ratio | 0.99 | 1.26 |

As shown in Table IX, the temperature of nitrogen affects the sizes of gas bubbles which are formed as a result of injecting nitrogen gas into edible oils and/or fats. The sizes of gas bubbles are shown to be decreased when the temperature of nitrogen is increased. The smaller gas bubble sizes increase the gas-liquid interfacial area, thereby improving the mass transfer of the fatty acid and other impurities in the edible oils and/or fats to the gas phase. The surface area to volume ratio as shown in Table IV confirms the availability of the greater impurity entraining surface area for a given volume of gas when the gas is preheated prior to its injection into the edible oils and/or fats. In addition to providing the greater impurity entraining surface, the gas can be uniformly distributed in the stripping gas distributing means when nitrogen is preheated. Due to this uniformity, a similar amount of the gas passes through a plurality of the orifice openings in the gas distributing means, thereby maximizing the removal of impurities entrained in the oil and/or fat.

The present invention imparts various advantages in deodorizing edible oils and/or fats by (1) using a particular amount of a non-condensible inert gas as a stripping medium, (2) distributing the particular amount of the non-condensible inert gas in a particular way and/or (3) preheating the particular amount of the non-condensible inert gas prior to its injection into the edible oils and/or fats. The advantage can be seen in (1) the quality and quantity of the recovered deodorized edible oil and/or fat product, (2) the reduction in the motive steam requirement, (3) the reduction in the cooling water requirement, (4) the reduction in the amount of the non-condensible inert gas used, (5) the reduction in the difficulty of removing the non-condensible inert gas and (6) the obtention of a useful by-product having a large amount of fatty acid.

Although the process of this invention has been described in detail with reference to certain embodiments, those skilled in the art will recognize that there are other embodiments of the invention within the spirit and scope of the claims.

What is claimed is:

1. A process for deodorizing edible oils and/or fats, said process comprising: heating edible oil and/or fat to an elevated temperature; introducing or injecting non-condensible inert gas into said edible oil and/or fat to strip or remove substances that impart disagreeable odor and taste to said edible oil and/or fat to obtain edible quality oil and/or fat; and recovering the resulting edible quality oil and/or fat, wherein an amount of said non-condensible inert gas introduced or injected is substantially less than the theoretically required amount for deodorizing said edible oil and/or fat and wherein said non-condensible inert gas is preheated before it is introduced or injected into said edible oil and/or fat.

2. The process according to claim 1, wherein said amount of non-condensible inert gas employed is in the range of about 22 scf of said non-condensible inert gas per ton of said edible oil and/or fat to about 230 scf of said non-condensible inert gas per ton of said edible oil and/or fat.

3. The process according to claim 2, wherein said amount of non-condensible inert gas employed is in the range of about 70 scf of noncondensible inert gas per ton of said edible oil and/or fat to about 170 scf of non-condensible inert gas per ton of said edible oil and/or fat.

4. The process according to claim 1, wherein said non-condensible inert gas is preheated to a temperature of about at least 100° C.

5. The process according to claim 4, wherein the temperature of the preheated non-condensible inert gas is equal to or less than a deodorization temperature.

6. The process according to claim 1, wherein said non-condensible inert gas is introduced or injected into said edible oil and/or fat at a sonic velocity.

7. The process according to claim 1, wherein said non-condensible inert gas comprises nitrogen.

8. The process according to claim 1, wherein said edible oil and/or fat is deodorized at a temperature of about 150° C. to about 270° C.

9. The process according to claim 8, wherein said edible oil and/or fat is deodorized at a pressure of about 0.1 to about 6 mmHg vacuum.

10. The process according to claim 1, wherein said edible oil and/or fat is heated in a deodorization tower having a plurality of trays or cells as it flows cross currently with respect to the direction of the movement of said non-condensible inert gas.

11. The process according to claim 10, wherein said edible oil and/or fat is preheated by indirectly heat exchanging with the discharging edible quality oil and/or fat prior to its introduction into said deodorization tower.

12. The process according to claim 11, wherein the preheated edible oil and/or fat is deaerated with nitrogen prior to its introduction into said deodorization tower.

13. The process according to claim 9, wherein said non-condensible inert gas is apportioned among some of said plurality of trays or cells, the apportionment of said non-condensible inert gas being such that the amount of said inert gas introduced to at least one tray located in the upper portion of said tower or at least one first cell located in the vicinity of the edible oil and/or fat inlet in said tower is greater than that introduced to at least one tray located in the mid portion of the tower or at least one intermediate cell which proceeds said at least one first cell in said tower and the amount of said inert gas introduced to at least one tray locate in the lower portion of the tower or at least one final cell located in the vicinity of the deodorized oil and/or fat outlet in said tower is less than that introduced to said at least one tray located in the mid portion of the tower or said at least one intermediate cell which precedes said at least one final cell in said tower.

14. The process according to claim 13, wherein the amount of said non-condensible inert gas introduced to said at least one tray in the upper portion of the tower or said at least one first cell constitutes about 33% to about 65% by volume based on the total amount of said non-condensible inert gas introduced or injected into said edible oil and/or fat in the tower, the amount of said non-condensible inert gas introduced to said at least one tray located in the mid portion of the tower or said at least one intermediate cell constitutes about 25% to about 50% by volume based on the total amount of said noncondensible inert gas introduced or injected into said edible oil and/or fat in the tower and the amount of said non-condensible inert gas introduced to said at least one tray located in the lower portion of the tower or said at least one final cell constitutes about 10% to about 33% by volume based on the total amount of said non-condensible inert gas introduced or injected into said edible oil and/or fat in the tower.

15. The process according to claim 14, wherein said amount of said non-condensible inert gas introduced to some of said plurality of trays or cells is controlled by adjusting the sizes of orifice openings or valves.

16. The process according to claim 1, wherein said edible oil and/or fat is physically refined prior to deodorization.

17. The process according to claim 1, wherein said edible oil and/or fat is chemically refined prior to deodorization.

18. The process according to claim 1, wherein said edible oil and/or fat is subject to degumming, neutralizing, dewaxing, filtrating, decoloring, breaching, hydrogenating, winterizing, filtering and/or deaerating prior to deodorization.

19. A process for deodorizing edible oils and/or fats in a deodorization tower, said process comprising: heating edible oil and fat to an elevated temperature; preheating non-condensible inert gas to at least about 30° C.; introducing or injecting the preheated non-condensible inert gas into said edible oil and/or fat to strip or remove substances that impart disagreeable odor and taste to said oil and/or fat to obtain edible quality oil and/or fat; and recovering the resulting edible quality oil and/or fat, wherein an amount of said preheated non-condensible inert gas introduced or injected is in the range of abut 22 scf to about 230 scf of said noncondensible inert gas per ton of said edible oil and/or fat.

20. The process according to claim 19, wherein said non-condensible gas is introduced or injected into said oil and/or fat at sonic velocity.

* * * * *